US006132219A

United States Patent [19]

Sobhani et al.

[11] Patent Number: 6,132,219

[45] Date of Patent: Oct. 17, 2000

[54] PLANETARY CONNECTOR

[75] Inventors: Mohi Sobhani, Encino; Arthur B. Naselow, Cheviot Hills; Llewellyn S. Dougherty, Playa Del Rey, all of Calif.

[73] Assignee: Raytheon Company, Lexington, Mass.

[21] Appl. No.: 09/211,444

[22] Filed: Dec. 15, 1998

[51] Int. Cl.[7] ..... H01R 39/28

[52] U.S. Cl. ..... 439/17; 439/21

[58] Field of Search ..... 439/17, 19, 21, 439/22, 20, 67

[56] References Cited

U.S. PATENT DOCUMENTS

| | | | |
|---|---|---|---|
| 5,588,843 | 12/1996 | Sobhani | 439/22 |
| 5,704,792 | 1/1998 | Sobhani | 439/21 |
| 5,851,120 | 12/1998 | Sobhani | 439/17 |

FOREIGN PATENT DOCUMENTS

| | | | |
|---|---|---|---|
| 2642909 | 8/1990 | France | 439/17 |

*Primary Examiner*—Gary F. Paumen

*Attorney, Agent, or Firm*—Colin M. Raufer; Leonard A. Alkov; Glenn H. Lenzen, Jr.

[57] ABSTRACT

Planetary connectors for coupling signals and power between stationary and moving structures. The planetary connector comprises a pressure plate that abuts a conformal pad that in turn contacts a first printed wiring board having a plurality of concentric conductive rings that face the interior of the connector. A second printed wiring board, which may be backed by a second pressure plate, is disposed at an end of the connector distal from the first printed wiring board that has a plurality of concentric conductive rings 18*a* that face the interior of the connector. A ball bearing retainer that retains a plurality of metal ball bearings is disposed between the flexible printed wiring boards, such that the ball bearings make electrical contact with the conductive rings of the rigid printed wiring boards. A shaft extends through all components. A selected printed wiring board is mounted to a rotating structure and the other printed wiring board is mounted a stationary platform, and a plurality of bearings are coupled to the shaft that allow the selected printed wiring board to rotate relative to the other printed wiring board. One embodiment of the connector comprises a flexible printed wiring board and a rigid printed wiring board. Another embodiment of the connector comprises two flexible printed wiring boards.

13 Claims, 3 Drawing Sheets

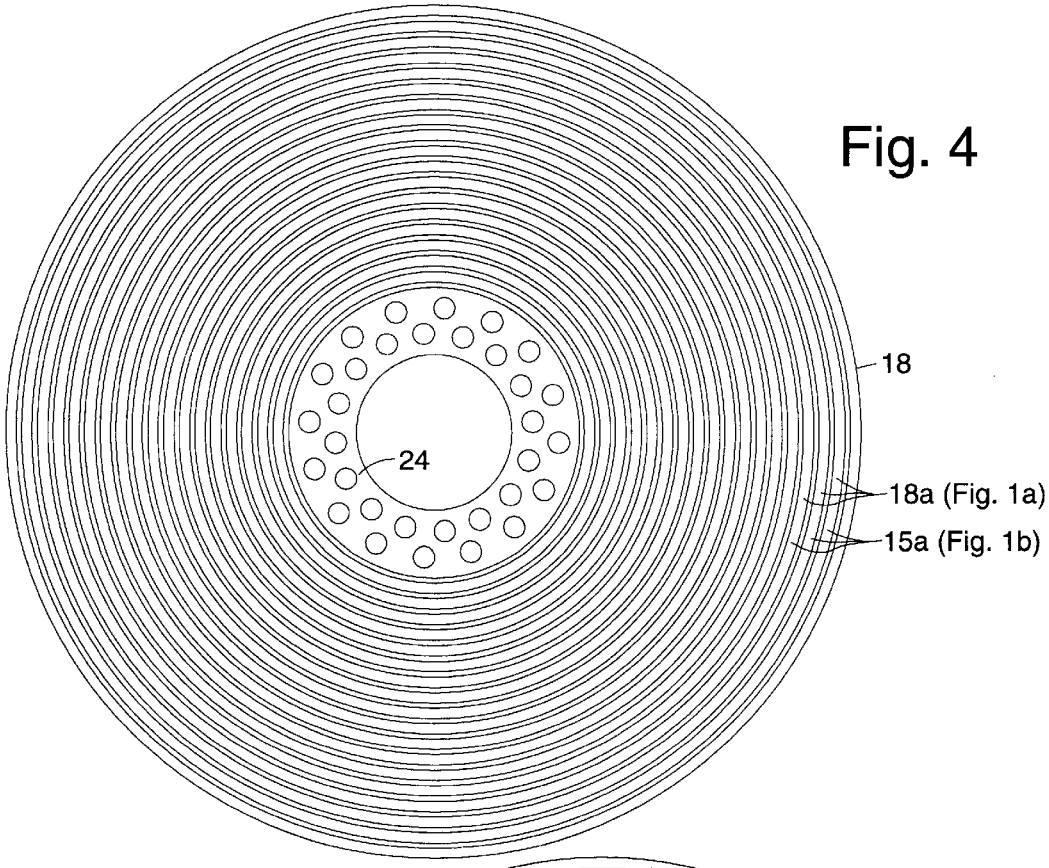
Fig. 4
Fig. 5
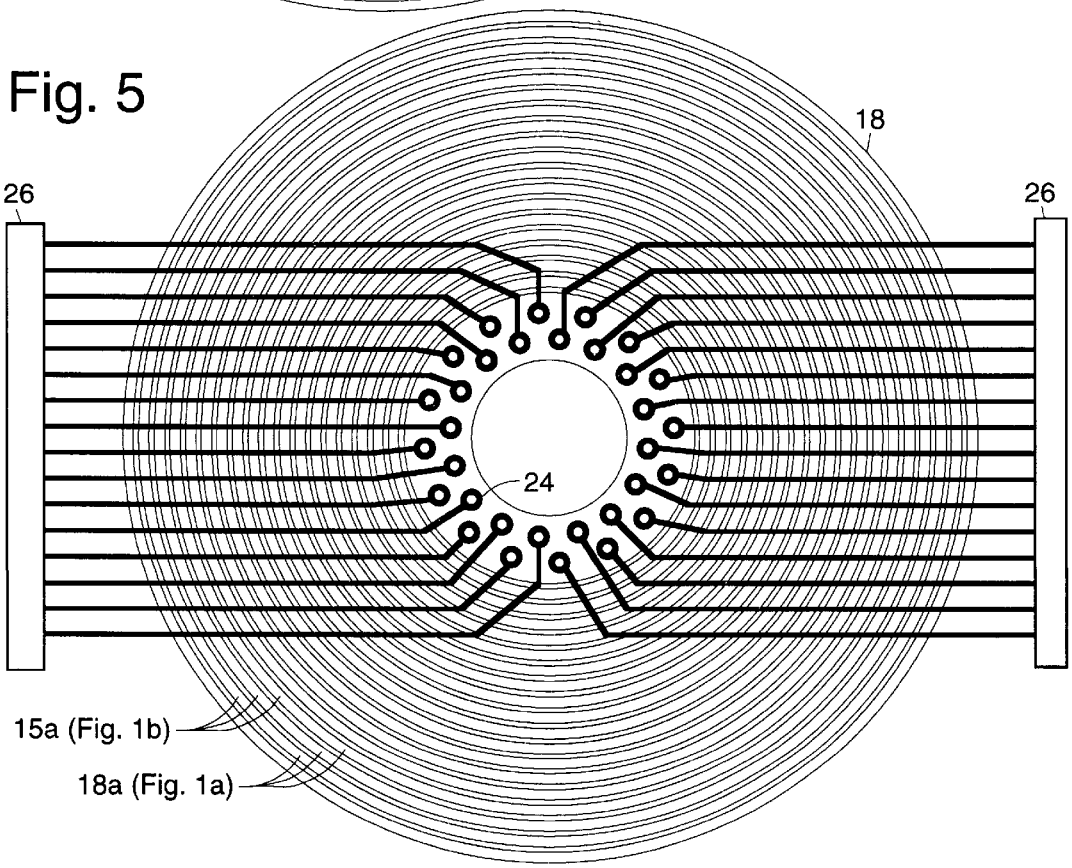

PLANETARY CONNECTOR

BACKGROUND

The present invention relates generally to rotary connectors, and more particularly, to improved planetary connectors for use in coupling signals and power between stationary and moving structures.

Conventional rotary connectors employ the use of cable-wrap connectors, slip rings, roll rings, brushes and motors, and telephone wire coils. The disadvantages of conventional rotary connector designs are as follows. Cable-wrap connectors have low reliability, are expensive, are hard to install, are prone to fail in the field, and have limited rotation. Slip rings have low reliability and have an unworkable geometry. Slip rings also are prone to brush burns, and they vibrate. Roll rings are costly and have an unworkable geometry. Brush and motor designs are not applicable to the design of rotary connectors, and are expensive. Similarly, telephone wire coils are bulky, and are not generally applicable to the design of rotary connectors. Telephone cords have a relatively short life span, have limited rotation, and not readily adaptable for large number of signals.

To overcome the limitations of these conventional rotary connectors, the assignee of the present invention has developed various rotary connectors that provide a more reliable and low cost alternative to conventional rotary connectors. Such rotary connectors are disclosed in U.S. Pat. No. 5,575,664, entitled "Ball Contact Rotary Connector", and U.S. patent application Ser. No. 08/680,075, filed Jul. 15, 1996, entitled "Spring Loaded Rotary Connector", for example, all of which are assigned to the assignee of the present invention. The present invention is an improvement over these and other rotary connectors.

Accordingly, it is an objective of the present invention to provide for improved planetary connectors for use in coupling signals and power between stationary and moving structures.

SUMMARY OF THE INVENTION

To accomplish the above and other objectives, the present invention provides for planetary connectors that use printed wiring technology and rolling balls. The planetary connectors are capable of coupling signals and power between stationary and moving structures.

The planetary connector comprises a pressure plate that abuts a conformal pad that in turn contacts a first printed wiring board that has a plurality of concentric conductive rings that face the interior of the connector. A second printed wiring board is disposed at an end of the connector distal from the first printed wiring board that comprises a plurality of concentric conductive rings that face the interior of the connector. A ball bearing retainer that retains a plurality of metal ball bearings is disposed between the flexible printed wiring boards, such that the ball bearings make electrical contact with the conductive rings of the rigid printed wiring boards.

A shaft extends through the pressure plate, rigid printed wiring boards and ball bearing retainer. A selected printed wiring board is mounted to a rotating structure and the other printed wiring board is mounted a stationary platform and a plurality of bearings are coupled to the shaft that allow the selected printed wiring board to rotate relative to the other printed wiring board.

Specific advantages of the planetary connectors are that they have a low profile, have a modular construction, may be easily replaced upon failure, provide for cost saving over other technology, have relatively high reliability in harsh environments, provide for secure transmission of signals, and can rotate 360 degrees.

One specific purpose of the present invention is to replace bulky and unreliable slip rings that are currently used in most high performance aircraft, missiles and satellites, and naval vehicles such as submarines and surface ships. For example, the present invention may be advantageously used in satellites, night vision systems, radar systems, automobiles, helicopters, and inertial navigation systems, for example.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 4 illustrates a top view of a rigid printed wiring board and flexprint circuit used in the planetary connectors of FIGS. 1*a* and 1*b*; and FIG. 5 illustrates a bottom view of the rigid printed wiring board and flexprint circuit shown in FIG. 4.

DETAILED DESCRIPTION

Figure 1A:
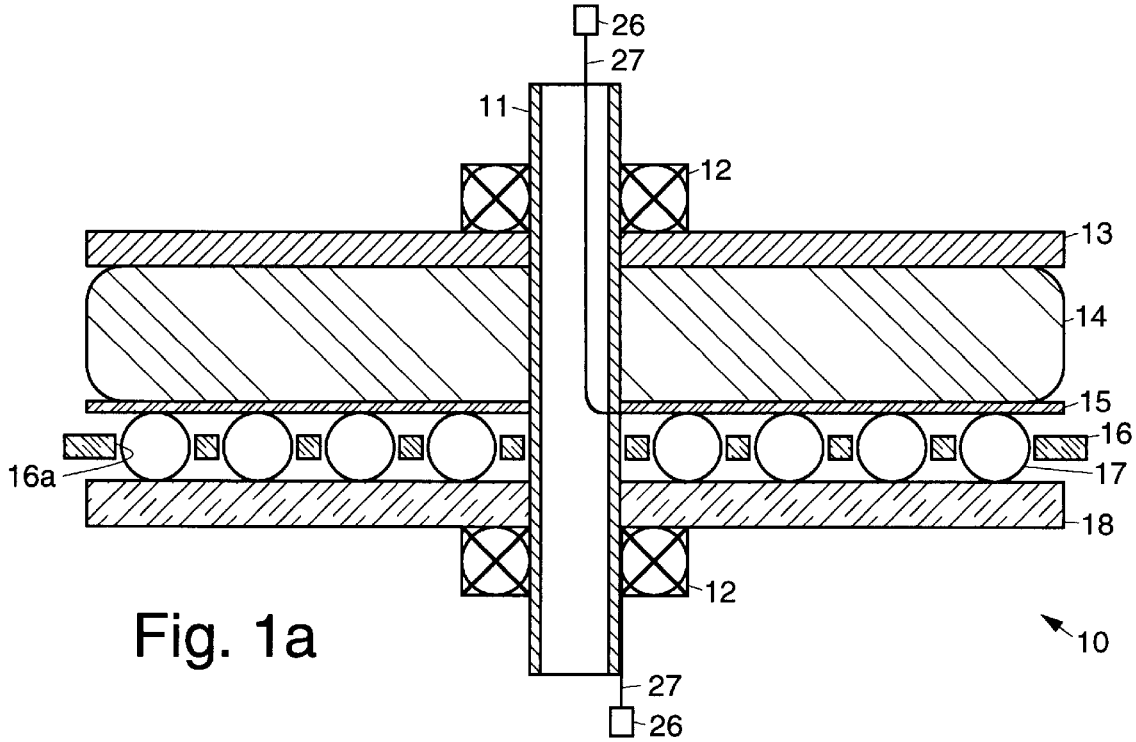
FIG. 1*a* illustrates a partial cross-sectional view of a first embodiment of a planetary connector in accordance with the principles of the present invention.

Referring to the drawing figures, FIG. 1*a* illustrates a partial cross-sectional view of a first embodiment of a planetary connector 10 in accordance with the principles of the present invention. This embodiment of the planetary connector 10 comprises a pressure plate 13 that presses against a conformal pad 14, which may be made from compressible urethane, for example. The conformal pad 14 presses against one side of a flexible printed wiring board 15, or flexprint circuit 15. The flexprint circuit 15 comprises a plurality of concentric conductive rings 15*a* (FIG. 3) that face the interior of the connector 10. The conductive rings 15*a* are coupled by way of a plurality of wires 27 to a connector 26 that is used to mate with electrical circuits external to the connector 10.

A rigid printed wiring board 18 is disposed at an end of the connector 10 distal from the flexprint circuit 15 and has a plurality of concentric conductive tracks 18*a* having grooves 18*b* (FIG. 4) machined therein that face the interior of the connector 10. The rigid printed wiring board 18 may be made of a brass/copper/polyimide laminate and is constructed using rigid printed wiring board technology. The conductive tracks 18*a* are also coupled by way of a plurality of wires 27 to a connector 26 that is used to mate with electrical circuits external to the connector 10.

A ball bearing retainer 16 has a plurality of openings 16*a* that retain a plurality of metal ball bearings 17 therein. The grooves 18*b* machined in the tracks 18*a* constrain movement of the ball bearings 17 within a circular path. The ball bearings 17 make electrical contact with the conductive rings 15*a* of the flexprint circuit 15 and the conductive rings 18*a* of the rigid printed wiring board 18.

A rotatable shaft 11 is disposed through the pressure plate 13, the conformal pad 14, the flexprint circuit 15, the ball bearing retainer 16, and the rigid printed wiring board 18. Two bearings 12 are disposed outside of the pressure plate 13 and the rigid printed wiring board 18 which allow the shaft 11 and the rotating component(s) (i.e. the pressure plate 13, the conformal pad 14 and the flexprint circuit 15, or the rigid printed wiring board 18) to rotate.

Thus, in this first embodiment of the connector 10, the plurality of metal ball bearings 17 are sandwiched between the rigid printed wiring board 18 and the cushioned flexprint circuit 15. The rigid printed wiring board 18 may be mounted to a stationary platform and the cushioned flexprint circuit 15 may be mounted to a rotating structure or component, or vice-versa and the ball bearings 12 permit relative rotation and electrical connection therebetween. As rotation occurs the ball bearings 17 interconnect the circular conductive circuits located on the rigid printed wiring board 18 and cushioned flexprint circuit 15. Depending upon whether the rigid printed wiring board 18 or the flexprint circuit 15 is stationary or rotating, the wires 27 connected to the rotating component pass through the center of the shaft 11 and connect to the connector 26. The other stationary component has the wires 27 connected to it pass along the outside of the shaft 11 through an opening in the appropriate bearing 12 and connect to the connector 26.

The connector 10 thus provides for a structure wherein the ball bearings 17 are compressed between and make electrical contact with the circular conductive circuits formed on the rigid printed wiring board 18 and cushioned flexprint circuit 15. Deviations from an ideal geometry are accommodated by deformations in the flexible printed wiring board 15 (flexprint circuit 15).

Figure 1B:
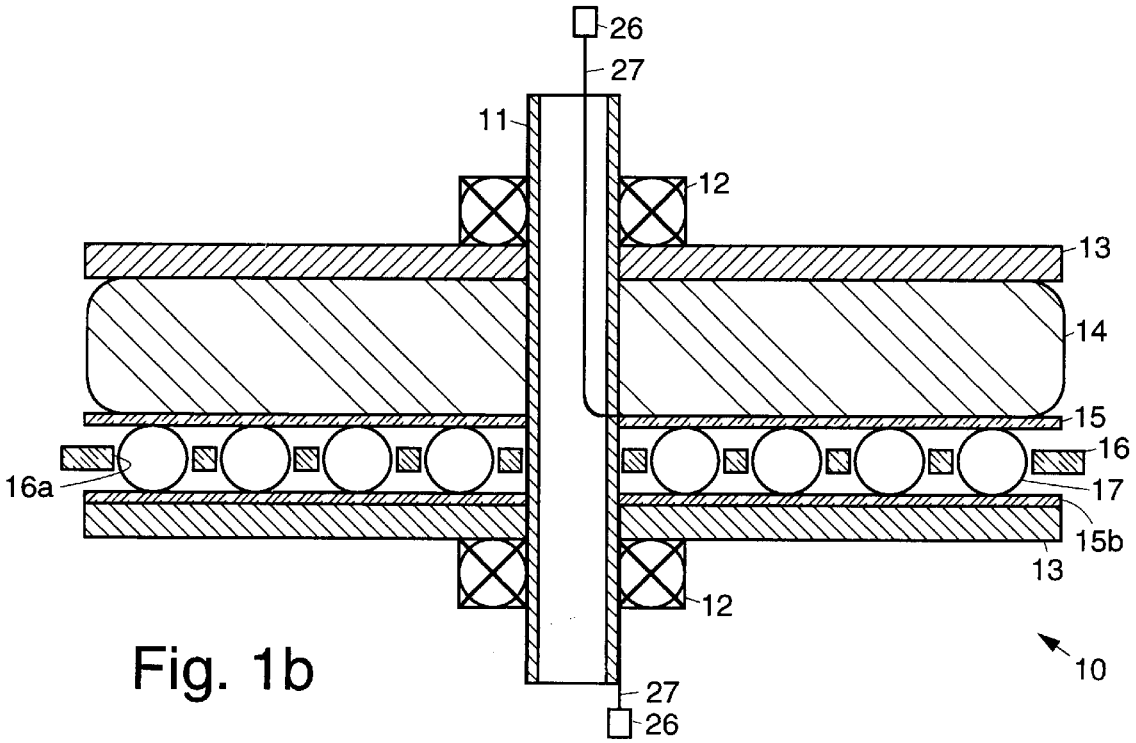
FIG. 1*b* illustrates a partial cross-sectional view of a second embodiment of a planetary connector in accordance with the principles of the present invention.

Referring now to FIG. 1*b*, it illustrates a partial cross-sectional view of a second embodiment of a planetary connector 10 in accordance with the principles of the present invention. This embodiment of the planetary connector 10 is substantially the same as the planetary connector 10 of FIG. 1*a*, except that the rigid printed wiring board 18 is replaced by a second flexible printed wiring board 15*b* (flexprint circuit 15*b*) which is supported by a second pressure plate 13 disposed between it and a second bearing 12.

In this embodiment of the planetary connector 10, the ball bearings 17 make electrical contact with the conductive rings 15*a* of both flexprint circuits 15, 15*b*.

The second embodiment of the connector 10 provides for a structure wherein the ball bearing 17 are compressed between and make electrical contact with the circular conductive circuits formed on the cushioned flexprint circuit 15 and the second flexible printed wiring board 15*b* (flexprint circuit 15*b*). Deviations from an ideal geometry are accommodated by deformations in the flexible printed wiring board 15, 15*b*.

Figure 2:
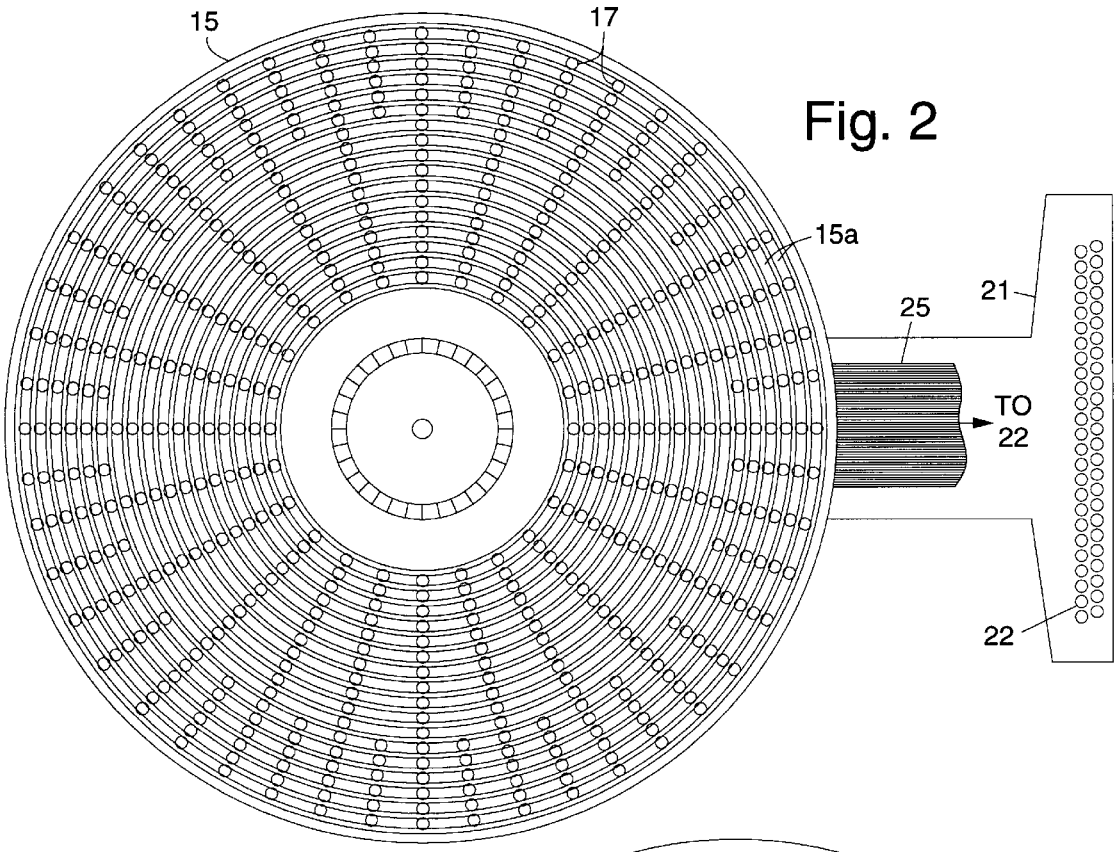
FIG. 2 illustrates a cushioned flexprint circuit used in the planetary connectors of FIGS. 1*a* and 1*b;*

Again, in the second embodiment of the connector 10, the conductive rings 15*a* of the flexprint circuits 15, 15*b* are coupled by way of respective pluralities of wires 27 to respective connectors 26 that is used to mate with electrical circuits external to the connector 10. The wires 26 pass through the center of the shaft 11 or outside the shaft 11, depending upon which flexprint circuit 15, 15*b* rotates and which is stationary Details of the components making up the planetary connectors 10 are discussed below with reference to FIGS. 2–6. FIG. 2 illustrates the cushioned flexprint circuit 15 used in the planetary connectors 10 of FIGS. 1*a* and 1*b*. Typical locations of the ball bearings 17 are also shown in FIG. 2. FIG. 2 shows the plurality of concentric conductive rings 15*a* formed on the interior-facing surface of the cushioned flexprint circuit 15. The cushioned flexprint circuit 15 has a connector portion 21 with a plurality of connector pads 22 and a corresponding plurality of electrical traces 25 that are used to connect the conductive rings 15*a* to external electrical circuits (not shown). This permits coupling of signal and power to and from one side of the connector 10. It is to be understood that the manner in which electrical connections are made between the conductive rings 15*a* and the connector pads 22 or external electrical circuits may be accomplished using hard wiring, flexprint circuits, or any other suitable electrical connection arrangement.

Figure 3:
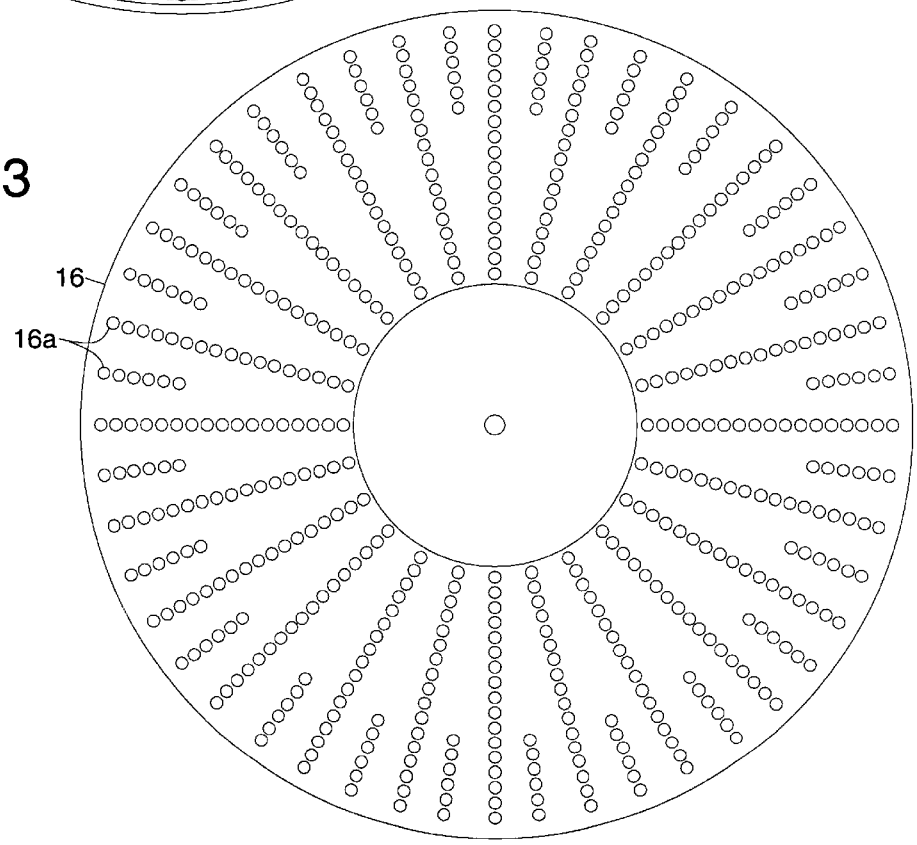
FIG. 3 illustrates a ball bearing retainer used in the planetary connector of FIGS. 1*a* and 1*b;*

FIG. 3 illustrates the ball bearing retainer 16 used in the planetary connectors 10 shown in FIGS. 1*a* and 1*b*. The locations of the openings 16*a* through the ball bearing retainer 17 that retain the ball bearings 17 is shown. The ball bearing retainer 16 shown in FIG. 2 are disposed in the openings 16*a* in the ball bearing retainer 16 shown in FIG. 2.

FIG. 4 illustrates a top view of the rigid printed wiring board 18 used in the first embodiment of the connector 10 shown in FIG. 1*a*, and also illustrates the second flexible printed wiring board 15*b* used in the second embodiment of the connector 10 shown in FIG. 1*b*. The rigid printed wiring board 18 has a plurality of conductive grooves 18*a* formed on a surface that faces the interior of the connector 10. A plurality of conductive pads 24 is provided adjacent the center of the rigid printed wiring board 18 that are connected to the plurality of conductive grooves 18*a*. In the case of the second flexible printed wiring board 15*b*, it has a plurality of conductive rings 15*a* or traces 15*a* formed on the surface that faces the interior of the connector 10.

FIG. 5 illustrates a bottom view of the rigid printed wiring board 18 and second flexible printed wiring board 15*b* shown in FIG. 4. In either version, a plurality of electrical connections 26 are formed between the conductive pads 24 and connectors 27 that are used to connect to the external electrical circuits. Again, it is to be understood that the manner in which the electrical connections 26 are made between the conductive pads 24 and the connectors 27 or external electrical circuits may be accomplished using hard wiring, flexprint circuits, or any other suitable electrical connection arrangement.

Thus, planetary connectors 10 have been disclosed wherein a plurality of metal ball bearings 17 are sandwiched between two flexprint circuits 15, 15*b* or between a printed wiring board 18 and a cushioned flexprint circuit 15. One side of the sandwich is mounted stationary on a platform and the other side is mounted via ball bearings 12 to a rotating structure or component. As rotation occurs the balls 17 interconnect circular conductive circuits 15*a*, 18*a* located on the flexprint circuits 15, 15*b*, or on the printed wiring board 18 and the cushioned flexprint circuit 15.

The planetary connectors 10 have a low profile, have a modular construction, may be easily replaced upon failure, provide for cost saving over other technology, have relatively high reliability in harsh environments, provide for secure transmission of signals, and can rotate 360 degrees. The planetary connectors 10 may readily replace bulky and unreliable slip rings that are used in aircraft. missiles and satellites, and naval vehicles such as submarines and surface ships. For example, the planetary connectors 10 may be used in satellites, night vision systems, radar systems, automobiles, helicopters, and inertial navigation systems, for example.

Thus, improved planetary connectors for use in coupling signal and power lines on stationary parts to rotary moving parts have been disclosed. It is to be understood that the described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A planetary connector comprising:

a pressure plate;

a first printed wiring board that comprises a plurality of concentric conductive rings that face the interior of the connector;

a conformal pad disposed between the pressure plate and the first printed wiring board;

a second printed wiring board disposed at an end of the connector distal from the first printed wiring board that comprises a plurality of concentric conductive rings 13 that face the interior of the connector;

a ball bearing retainer that retains a plurality of metal ball bearings therein disposed between the flexible printed wiring boards, such that the ball bearings make electrical contact with the conductive rings of the printed wiring boards;

a shaft extending through the pressure plate, rigid printed wiring boards and ball bearing retainer; and a plurality of bearings coupled to the shaft for allowing one of the printed wiring boards to rotate relative to the other printed wiring board.

2. The planetary connector of claim 1 wherein the one printed wiring board is mounted to a rotating structure and the other printed wiring board is mounted a stationary platform.

3. The planetary connector of claim 1 wherein the concentric conductive rings of the second printed wiring board comprises a plurality of concentric conductive tracks having grooves therein that face the interior of the connector.

4. The planetary connector of claim 1 wherein the second printed wiring board comprises a rigid printed wiring board.

5. The planetary connector of claim 1 wherein the conformal pad comprises compressible urethane.

6. The planetary connector of claim 1 wherein the second printed wiring board comprises a brass/copper/polyimide laminate.

7. A planetary connector comprising:

a pressure plate;

a conformal pad disposed adjacent to the pressure plate;

a flexible printed wiring board disposed adjacent to the conformal pad that comprises a plurality of concentric conductive rings that face the interior of the connector;

a rigid printed wiring board disposed at an end of the connector distal from the flexible printed wiring board that comprises a plurality of concentric conductive tracks having grooves therein that face the interior of the connector;

a ball bearing retainer that retains a plurality of metal ball bearings therein disposed between the flexible printed wiring board and the rigid printed wiring board, such that the ball bearings make electrical contact with the conductive rings of the flexible printed wiring board and the conductive tracks of the rigid printed wiring board;

a shaft extending through the pressure plate, printed wiring boards and ball bearing retainer;

a plurality of bearings coupled to the shaft for allowing one of the printed wiring boards to rotate relative to the other printed wiring board.

8. The planetary connector of claim 7 wherein the one printed wiring board is mounted to a rotating structure and the other printed wiring board is mounted to a stationary platform.

9. The planetary connector of claim 7 wherein the conformal pad comprises compressible urethane.

10. The planetary connector of claim 7 wherein the rigid printed wiring board comprises a brass/copper/polyinide laminate.

11. A planetary connector comprising:

a pressure plate disposed adjacent one end of the connector;

a flexible printed wiring board that comprises a plurality of concentric conductive rings that face an interior of the connector;

a conformal pad disposed between the pressure plate and the first printed wiring board;

a second pressure plate disposed adjacent an opposite end of the connector;

a second flexible printed wiring board disposed adjacent to the second pressure plate that comprises a plurality of concentric conductive rings that face the interior of the connector;

a ball bearing retainer that retains a plurality of metal ball bearings therein disposed between the flexible printed wiring boards, such that the ball bearings make electrical contact with the conductive rings of the rigid printed wiring boards;

a shaft extending through the pressure plates, printed wiring boards and ball bearing retainer; and a plurality of bearings coupled to the shaft for allowing one of the printed wiring boards to rotate relative to the other printed wiring board.

12. The planetary connector of claim 11 wherein the one printed wiring board is mounted to a rotating structure and the other printed wiring board is mounted to a stationary platform.

13. The planetary connector of claim 11 wherein the conformal pad comprises compressible urethane.

* * * * *